US008104320B2

(12) United States Patent
Gilbert

(10) Patent No.: US 8,104,320 B2
(45) Date of Patent: Jan. 31, 2012

(54) METHOD AND APPARATUS FOR CORRUGATING SHEET METAL

(75) Inventor: Bruce N. Gilbert, Seattle, WA (US)

(73) Assignee: The Boeing Company, Chicago, IL (US)

( * ) Notice: Subject to any disclaimer, the term of this patent is extended or adjusted under 35 U.S.C. 154(b) by 369 days.

(21) Appl. No.: 12/032,387

(22) Filed: Feb. 15, 2008

(65) Prior Publication Data

US 2009/0205395 A1 Aug. 20, 2009

(51) Int. Cl.
*B21D 13/00* (2006.01)

(52) U.S. Cl. ..... 72/379.6; 72/195; 72/197

(58) Field of Classification Search ..... 72/192, 72/195, 197, 198, 240, 245, 248, 252.5, 379.6, 72/385, 98, 238
See application file for complete search history.

(56) References Cited

U.S. PATENT DOCUMENTS

| | | | | |
|---|---|---|---|---|
| 767,883 | A | 8/1904 | Grafton | |
| 827,419 | A | 7/1906 | Causer | |
| 1,018,399 | A | 2/1912 | Livingston | |
| 1,150,805 | A * | 8/1915 | Beran | 72/478 |
| 1,382,827 | A * | 6/1921 | Foster | 72/197 |
| 1,766,743 | A * | 6/1930 | Freeze | 72/180 |
| 2,513,777 | A | 7/1950 | Andre | |
| 2,643,688 | A * | 6/1953 | Crooker | 72/190 |
| 3,250,102 | A * | 5/1966 | Howeler | 72/40 |
| 3,470,053 | A * | 9/1969 | Rule | 156/207 |
| 3,830,088 | A | 8/1974 | Couper et al. | |
| 3,971,243 | A | 7/1976 | Jones | |
| 4,059,000 | A * | 11/1977 | Bodnar | 72/197 |
| 4,086,120 | A | 4/1978 | Cosby et al. | |
| 4,179,912 | A | 12/1979 | Culina et al. | |
| 4,291,561 | A | 9/1981 | Tipper | |
| 4,319,473 | A | 3/1982 | Franke, Jr. et al. | |
| 4,461,655 | A | 7/1984 | Kerridge | |
| 4,597,278 | A | 7/1986 | Hamada et al. | |
| 4,627,258 | A * | 12/1986 | Loges et al. | 72/196 |
| 4,810,588 | A * | 3/1989 | Bullock et al. | 428/603 |
| 4,835,850 | A * | 6/1989 | Eckold et al. | 29/243.529 |
| 4,874,457 | A | 10/1989 | Swieringa | |
| 5,595,082 | A | 1/1997 | Gandara | |
| 6,223,580 | B1 * | 5/2001 | Kirby | 72/379.6 |
| 6,834,525 | B2 * | 12/2004 | Leon et al. | 72/385 |
| 6,901,995 | B2 * | 6/2005 | Yamaguchi et al. | 165/152 |
| 7,197,808 | B2 * | 4/2007 | Zimprich | 29/458 |
| 7,343,769 | B2 * | 3/2008 | Sofue et al. | 72/379.6 |
| 2002/0134494 | A1 * | 9/2002 | Bruck et al. | 156/205 |

FOREIGN PATENT DOCUMENTS

JP 60-133931 A M * 7/1985

* cited by examiner

*Primary Examiner* — Edward Tolan
(74) *Attorney, Agent, or Firm* — Yee & Associates, P.C.

(57) ABSTRACT

An apparatus for bending sheet metal comprises a housing, a first shaft and a second shaft mounted in the housing, a motor, a first gear mounted on the first shaft, and a second gear mounted on the second shaft. The motor rotates both the first gear and the second gear. The first gear comprises a first plurality of components and the second gear comprises a second plurality of components. The first gear and the second gear are capable of engaging sheet metal passed between the gears while they are moving. The first and second plurality of components are capable of being configured to change a bend radius, a wavelength of waves formed in the sheet metal, and a distance between the first shaft and the second shaft can be adjusted to change an amplitude of waves formed in the sheet metal engaged by the first and second gears.

20 Claims, 14 Drawing Sheets

METHOD AND APPARATUS FOR CORRUGATING SHEET METAL

BACKGROUND INFORMATION

1. Field

The present disclosure relates generally to manufacturing components and in particular to a method and apparatus for shaping materials for components. Still more particularly, the present disclosure relates to a method and apparatus for forming waves in sheet metal.

2. Background

Corrugating sheet metal involves forming features, such as wrinkles, folds, alternating ridges and grooves, or waves in sheet metal. Although the corrugation of sheet metal to form wave shapes can create many forms, a common shape consists of circular arcs either directly connected to each other or connected by straight segments. This shape is often named after the mathematical sine wave, even though the actual shape may be slightly different. This type of process may be used to form various components. These components include those for use in aircraft. For example, a very efficient structural beam may be made by welding sheet metal flanges to a corrugated web.

Corrugated sheet metal may form efficient structural components that are capable of supporting high sheer loads or pressure loads. This high sheer load capability may be aided by the resistance to buckling of the corrugated sheet metal within the beams relative to standard flat webs. This corrugated sheet metal may form a web for a beam or some other support structure.

Support structures, such as beams, may be made from various materials including high strength lightweight materials, such as titanium alloy Ti 6Al-4V. Using titanium alloys may provide a high strength to weight ratio for aircraft components. These types of beams may be used in aircraft components such as floor beams, wing spars, and stabilizer spars. The use of this type of beam has been limited in part because of the time and expense in making these wave shaped forms. These wave shaped forms of sheet metal used in beams or other components are also referred to as corrugated webs or just webs.

Past processes for creating these corrugated webs for aircraft structures involve using a brake press to form each bend or wave in the corrugated web one at a time. This type of process also may require indexing holes for pre-punching in the strip of metal to accurately index each bend. These index holes may be used to properly space the waves while the strip stress is relieved in a furnace to obtain the desired wave dimensions in the web.

Brake forming, however, uses a brake press and is a slow and expensive manual process. As a result, this process is not especially useful for commercial production of aircraft. Further, the use of index holes formed into the metal is undesirable. As a result, the index holes are formed in excess metal that is later trimmed off of the web. Additionally, a stress relief step also adds to the cost and time needed to produce webs for use in aircraft components.

Another currently used process for forming waves or corrugations in sheet metal materials employs gears to form the waves. This type of process involves passing sheet metal between two gears with the gears engaging the sheet metal to form the wave shapes for the web. This type of technology, however, is typically used for forming materials, such as mild steel, soft aluminum, or cardboard.

The gear forming process requires different gears to accommodate different sheet metal gages or to produce waves of different shapes or sizes. Current gear forming equipment does not allow easy changing of the forming gears.

Another currently used process for creating waves in a material utilizing hot die forming or hot sizing. Hot die forming is a process for making accurate titanium sheet parts. In this process, a pre-formed or partially formed item may be placed between two fitted dies. This configuration is heated to around 1350 degrees Fahrenheit and pressed for about ten minutes. At this time and temperature, the material softens and creeps at an amount that is sufficient to set the dimensions without undesired spring back.

This type of process, however, is costly because the process requires a hot press with service and maintenance expenses. Additionally, the dies also are made from exotic high-temperature materials, which add to the cost. Further, die maintenance costs are present as well as the process being relatively slow as compared to the gear forming processes.

Therefore, it would be advantageous to have a method and apparatus that overcomes the problems described above, as well as possible other problems.

SUMMARY

The different advantageous embodiments provide a method and apparatus for forming waves in sheets of materials. In one advantageous embodiment, an apparatus for bending sheet metal comprises a housing, a first shaft mounted in the housing, a second shaft mounted in the housing in a position parallel to the first shaft, a motor, a first gear mounted on the first shaft, and a second gear mounted on the second shaft. The motor is capable of rotating both the first gear and the second gear. The first gear comprises a first plurality of components. The second gear comprises a second plurality of components. The first gear and the second gear are capable of engaging sheet metal passed between the first gear and the second gear while the first gear and the second gear are moving. The first plurality of components and the second plurality of components are capable of being configured to change a wavelength of waves formed in the sheet metal engaged by the first gear and the second gear and wherein a distance between the first shaft and the second shaft can be adjusted to change an amplitude of waves formed in the sheet metal engaged by the first gear and the second gear.

In another advantageous embodiment, an apparatus comprises a first gear and a second gear. The first gear comprises a first plurality of components and the second gear comprises a second plurality of components. The first plurality of components and the second plurality of components are capable of being configured to change at least one of a wavelength and a radius of waves formed in a sheet metal passed between and engaged by the first gear and the second gear when the first gear and the second gear move.

In still another advantageous embodiment, a method is present for forming waves in a sheet of material. A plurality of components is configured for a first gear and a second plurality of components for a second gear in a first configuration. The first gear in the first configuration and the second gear in the first configuration are moved. The sheet of material is passed between the first gear and the second gear while they move, wherein the sheet of material is engaged by the first gear and the second gear as the sheet of material passes between the first gear and the second gear to form waves in the sheet of material.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives and advantages thereof, will best be understood by reference to the following detailed description of an advantageous embodiment of the present disclosure when read in conjunction with the accompanying drawings, wherein:

DETAILED DESCRIPTION

Figure 1:
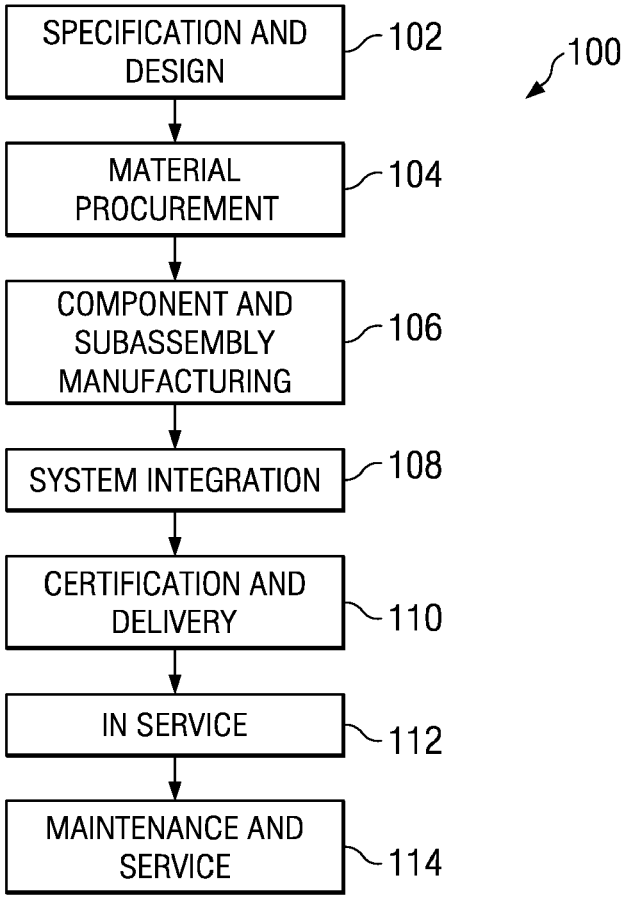
FIG. 1 is a diagram illustrating an aircraft manufacturing and service method in accordance with an advantageous embodiment.
Figure 2:
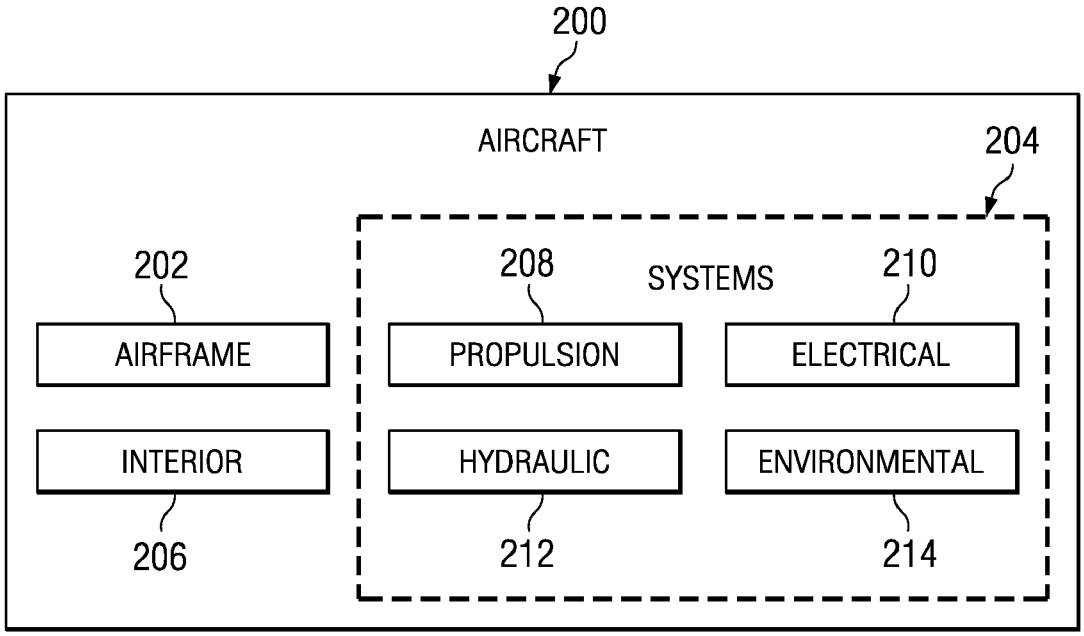
FIG. 2 is a diagram of an aircraft in which an advantageous embodiment may be implemented.

Referring more particularly to the drawings, embodiments of the disclosure may be described in the context of the aircraft manufacturing and service method 100 as shown in FIG. 1 and aircraft 200 as shown in FIG. 2. Turning first to FIG. 1, a diagram illustrating an aircraft manufacturing and service method is depicted in accordance with an advantageous embodiment. During pre-production, exemplary aircraft manufacturing and service method 100 may include specification and design 102 of aircraft 200 in FIG. 2 and material procurement 104. During production, component and subassembly manufacturing 106 and system integration 108 of aircraft 200 in FIG. 2 takes place. Thereafter, aircraft 200 in FIG. 2 may go through certification and delivery 110 in order to be placed in service 112. While in service by a customer, aircraft 200 in FIG. 2 is scheduled for routine maintenance and service 114, which may include modification, reconfiguration, refurbishment, and other maintenance or service.

Each of the processes of aircraft manufacturing and service method 100 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of venders, subcontractors, and suppliers; and an operator may be an airline, leasing company, military entity, service organization, and so on.

With reference now to FIG. 2, a diagram of an aircraft is depicted in which an advantageous embodiment may be implemented. In this example, aircraft 200 is produced by aircraft manufacturing and service method 100 in FIG. 1 and may include airframe 202 with a plurality of systems 204 and interior 206. Examples of systems 204 include one or more of propulsion system 208, electrical system 210, hydraulic system 212, and environmental system 214. Any number of other systems may be included. Although an aerospace example is shown, different advantageous embodiments may be applied to other industries, such as the automotive industry.

Apparatus and methods embodied herein may be employed during any one or more of the stages of aircraft manufacturing and service method 100 in FIG. 1. For example, components or subassemblies produced in component and subassembly manufacturing 106 in FIG. 1 may be fabricated or manufactured in a manner similar to components or subassemblies produced while aircraft 200 is in service 112 in FIG. 1.

One or more apparatus embodiments, method embodiments, or a combination thereof may be utilized during production stages, such as component and subassembly manufacturing 106 and system integration 108 in FIG. 1, for example, without limitation, by substantially expediting the assembly of or reducing the cost of aircraft 200. Similarly, one or more of apparatus embodiments, method embodiments, or a combination thereof may be utilized while aircraft 200 is in service 112 or during maintenance and service 114 in FIG. 1.

The different advantageous embodiments recognize that it would be desirable to make additional adjustments to the dimensions of a wave formed in a sheet of material more easily. The different advantageous embodiments also recognize that using gear forming processes to create waves in titanium sheet metal is much more difficult with materials that have a higher spring back as compared to steel, aluminum, or cardboard. Spring back is the tendency for a material, such as sheet metal, to return to its original shape.

Thus, as the spring back increases, the tendency to return back to its original shape is greater. The different advantageous embodiments recognize that difficulties in processing titanium sheets into corrugated webs are present because of problems in obtaining desired shapes. The different advantageous embodiments recognize that additional over-bending of the material is required such that the spring back causes the material to return to a form in the desired shape.

The difficulty with this process is that manufacturing corrugated webs with different metal gages or different shapes requires different sets of gears. If a gear is created and manufactured and the wave shape formed by the gear does not have the desired shape or dimensions, a new gear has to be designed and made.

Further, the different advantageous embodiments recognize that the use of corrugated webs in aircraft parts require closer tolerances in terms of dimensions and shape as compared to the current products in which a wave shaped material is formed. The different advantageous embodiments also have recognized that different actual material thicknesses and different manufacturers of the same specification for sheet metal forms differently. As a result, a single gear set may not be capable of forming parts to the desired accuracy even for a normal material gage.

The advantageous embodiments also recognize that the only currently available adjustment to alter the shape of a wave in a corrugated web is to adjust the space between the gear shafts on which the gears sit. This adjustment primarily changes the amplitude of the wave. As a result, the different advantageous embodiments recognize that no available adjustment is present to change other parameters of a wave, other than creating a new set of gears. These other parameters include, for example, a wave length and a radius bend for the wave.

Figure 3:
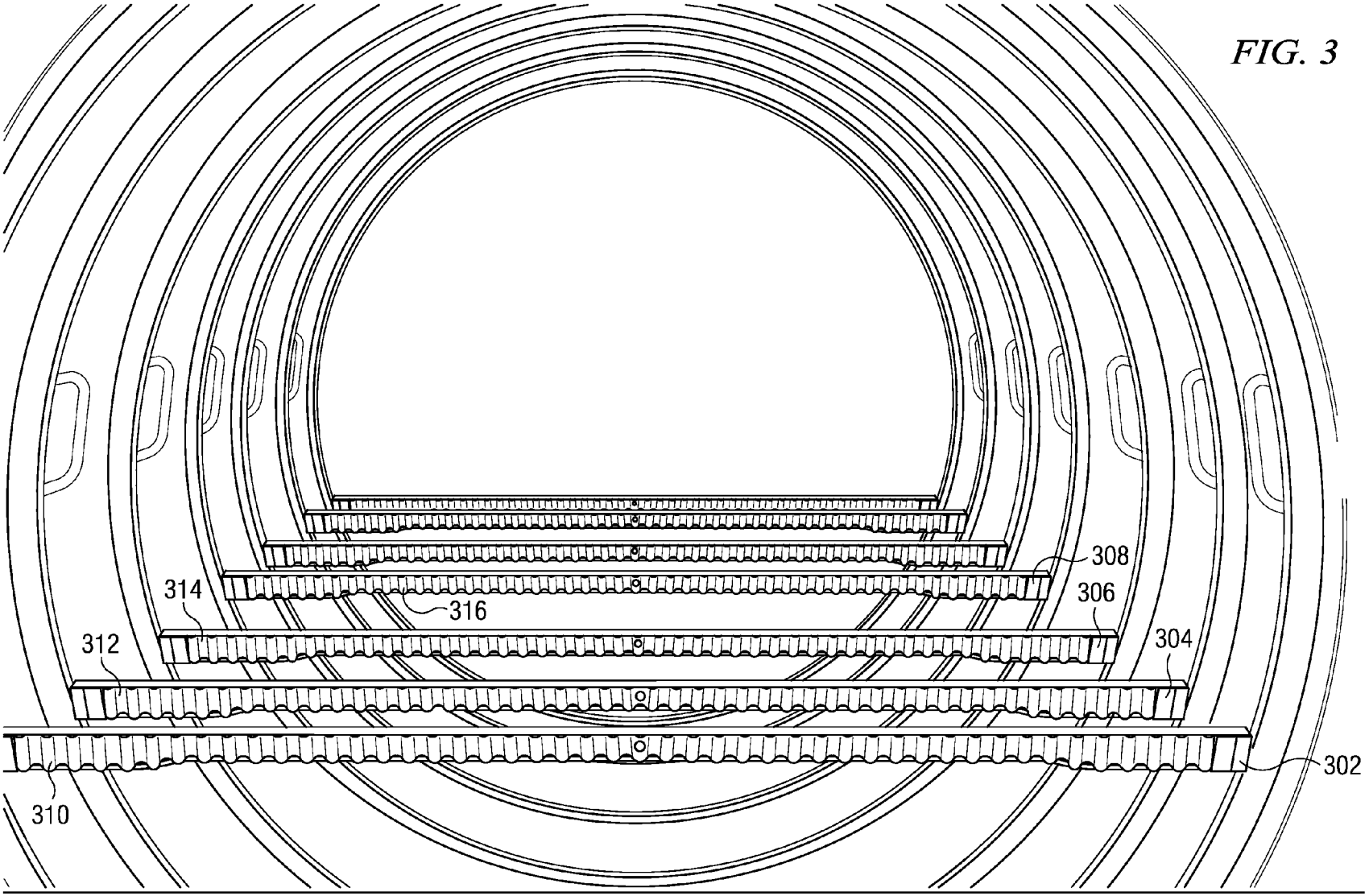
FIG. 3 is a diagram illustrating an interior portion of an aircraft fuselage containing components using corrugated materials in accordance with an advantageous embodiment.

With reference now to FIG. 3, a diagram illustrating an interior portion of an aircraft fuselage containing components using corrugated materials is depicted in accordance with an advantageous embodiment. In this illustrative example, structure 300 is an interior view of an aircraft fuselage, such as airframe 202 in FIG. 2.

In this example, floor beams, such as floor beams 302, 304, 306, and 308, are present. Each of these floor beams contains a corrugated web, such as corrugated webs 310, 312, 314, and 316. Of course, additional floor beams and corrugated webs are present within structure 300, but not identified in these examples. Corrugated webs 310, 312, 314, and 316 are examples of corrugated titanium sheet metal that may be formed using a method and apparatus of the different advantageous embodiments.

The different advantageous embodiments provide a method and apparatus for forming waves in materials that allows for adjustability of various features of waves, such as wave amplitude, wave length, and wave radius. An apparatus may include a housing, a first shaft mounted in the housing, and a second shaft mounted in the housing positioned parallel to the first shaft. The apparatus also may include a motor capable of rotating the first and second shaft.

Additionally, the apparatus may include a first gear and a second gear. The first gear is mounted on the first shaft while the second gear is mounted on the second shaft. The first gear is comprised of a first plurality of components capable of being configured. The second gear also is comprised of a second plurality of components capable of being configured. These different pluralities of components may be configured to change a wave length and a radius for the waves. The distance between the teeth or surfaces that engage a sheet of material may be changed to change the amplitude of the waves formed in a sheet of material. In some advantageous embodiments, the distance between shaft or the center of the gears may be adjusted or configured to make this change.

Figure 4:
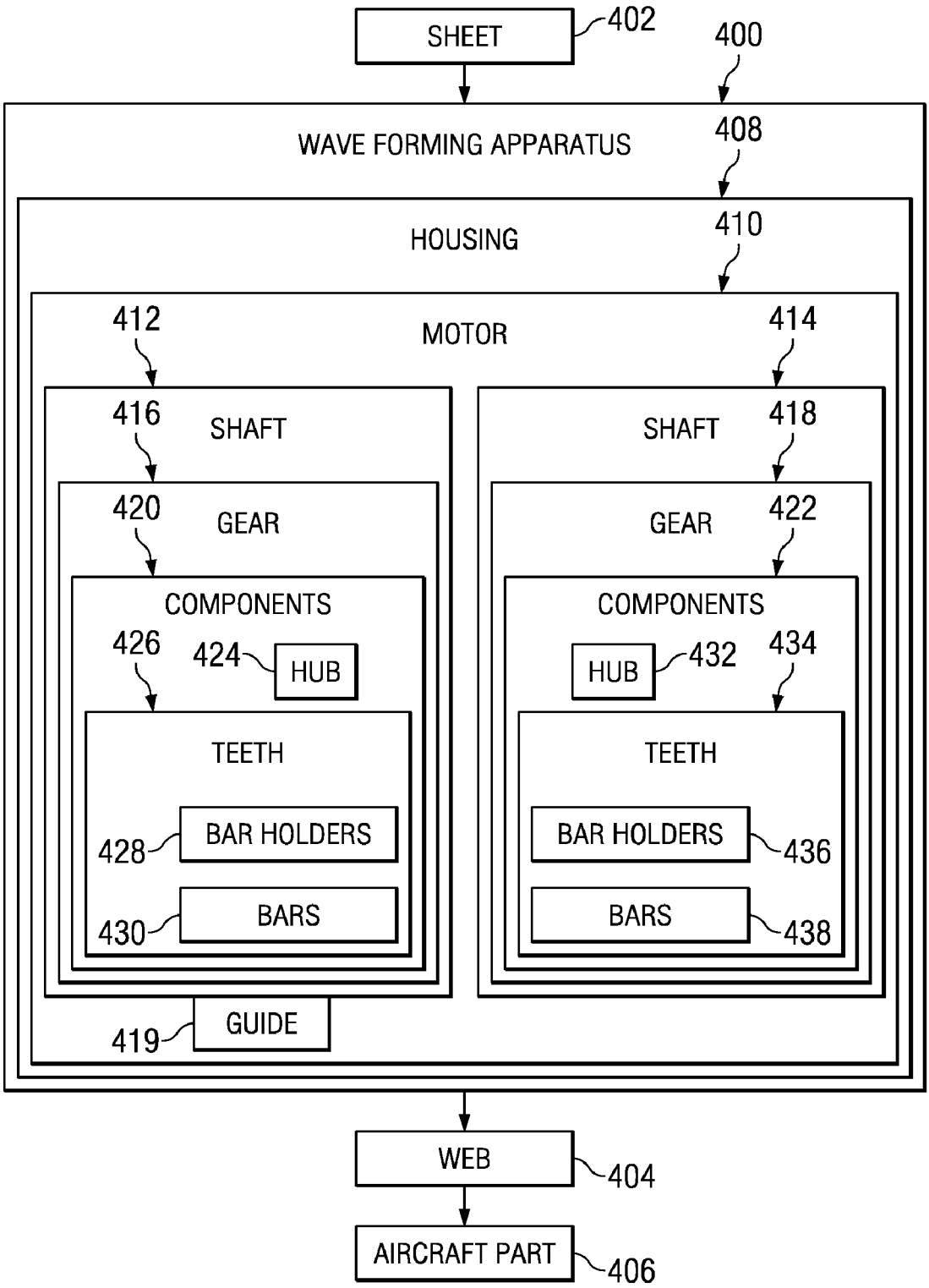
FIG. 4 is a block diagram of components used to create waves in materials in accordance with an advantageous embodiment.

Turning now to FIG. 4, a block diagram of components used to create waves in materials is depicted in accordance with an advantageous embodiment. In this example, wave forming apparatus 400 may be used to process sheet 402 to create waves in sheet 402. The result is web 404, which may be incorporated into aircraft part 406.

In these examples, sheet 402 may take various forms. Sheet 402 may be a sheet of material such as, for example, without limitation, titanium, titanium alloy, aluminum, steel, or any other suitable material. Also, sheet 402 may have different dimensions. In some embodiments, the dimensions may be such that sheet 402 may be referred to as a strip.

Aircraft part 406 may also take various forms. For example, aircraft part 406 may be a beam, such as beam 302 in FIG. 3. Aircraft part 406 also may take other forms, such as, for example, wingspars, stabilizer spars, or other suitable structures.

Wave forming apparatus 400 includes housing 408, which contains motor 410, shaft 412, shaft 414, gear 416, and gear 418. Shafts 412 and 414 may be turned or rotated by motor 410. Motor 410 may be coupled to shafts 412 and 414 directly or through other components, such as belts, chains, pulleys, and gears.

In these examples, shafts 412 and 414 have a distance that is adjustable with respect to each other. Gear 416 is mounted on shaft 412, while gear 418 is mounted on shaft 414. Thus, when shafts 412 and 414 turn, gears 416 and 418 also move or turn. Gears 416 and 418 are not single piece gears in these examples. Gears 416 and 418 are configurable gears in which each gear contains multiple components. In other words, gears 416 and 418 are configurable gears, which mean they have components that may be changed between processing sheets of materials.

Gear 416 contains components 420, while gear 418 contains components 422. Components 420 may include, for example, hub 424 and teeth 426. Teeth 426 may be adjustable and removable from hub 424. In these examples, teeth 426 include bar holders 428 and bars 430. In a similar fashion, components 422 for gear 418 include hub 432 and teeth 434. Teeth 434 are comprised of bar holders 436 and bars 438. Teeth 426 and 434 have ends with diameters capable of being adjusted to change a radius of the waves. In these examples, the diameters are adjusted by selecting bars 430 and 438 with different diameters.

In these examples, bar holders 428 are removably attached to hub 424, and bar holders 436 are removably attached to hub 432. Bars 430 are removably attached to bar holders 428, and bars 438 are removably attached to bar holders 436.

Bars 430 may come in a number of different diameters such that one plurality of bars may be switched out for another plurality of bars with a different diameter. By changing the diameter of the bars, the radius of a wave may be adjusted. In a similar fashion, bars 438 may include different diameters such that different diameter bars from bars 438 may be attached to bar holders 436 to change a radius of the waves. In these examples, the diameters of bars 430 and 438 are selected to have the same diameter with respect to the different sets.

Bar holders 428 and 436 may be adjusted to create different lengths for teeth 426 and teeth 434 on hubs 424 and 432. In this manner, a diameter of gear 416 and gear 418 may be changed. By changing the diameter of gears 416 and 418, the wave length of a wave in web 404 may be adjusted. The distance between gear 416 and gear 418 is selected such that sheet 402 is engaged by both of these gears. The distance between these gears also may be adjusted such that sheet 402 is still engaged by gears 416 and 418, but has a different amplitude when a wave is formed in web 404. Guide 419 may be used to guide sheet 402 between gears 416 and 418 to create web 404.

The illustration of components within wave forming apparatus 400 is not meant to imply architectural limitations to the manner in which various components may be implemented. In other advantageous embodiments, other components may be used in addition to or in place of the components illustrated in these examples. For example, in some advantageous embodiments, a bar holder and a bar may be a single component rather than two separate components that may be attached to each other.

Shafts 412 and 414 may be both turned directly by motor 410 or one of the shafts may be turned indirectly. For example, motor 410 may turn shaft 412 directly. Shaft 414 may turn as a result of gear 418 meshing with gear 416 while sheet 402 is passed between sheet 402 and engaged by gears 416 and 418. In this type of implementation, gear 418 is driven by the turning of gear 416 as shaft 412 is turned by motor 410. In this manner, motor 410 is capable of rotating both gears, directly or indirectly.

With this type of implementation, different teeth may be selected for attachment to hubs 424 and 432 with the different teeth having different diameters at the top of the teeth to change the radius of a wave. Further, the teeth may be selected to have different lengths to change the diameter of the gears. In other advantageous embodiments, hubs 424 and 432 may include mechanisms to change the positioning of teeth 426 and 434 to change the diameter of gears 416 and 418.

Figure 5:
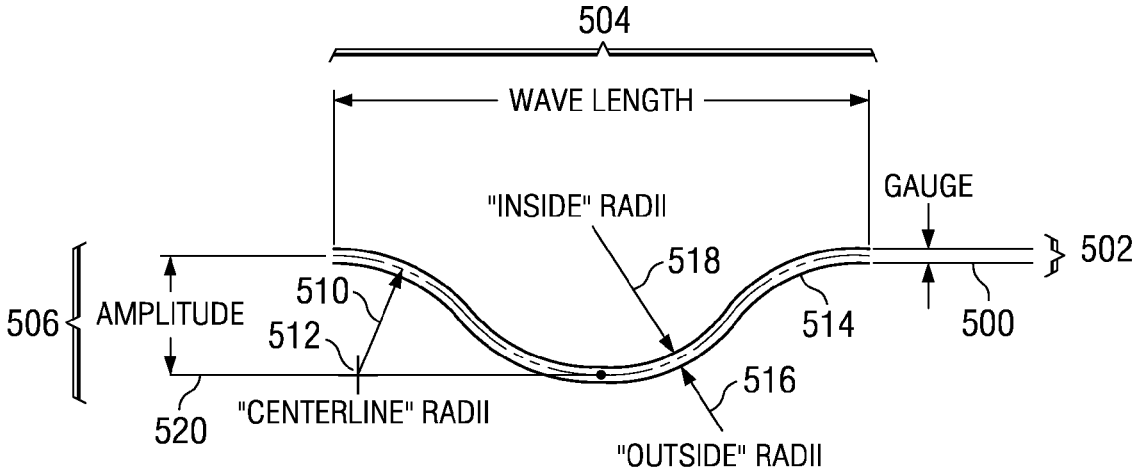
FIG. 5 is a diagram of a desired wave shape formed in sheet material in accordance with an advantageous embodiment.

With reference now to FIG. 5, a diagram of a sheet of material bent in a wave form is depicted in accordance with an advantageous embodiment. In this example, wave 500 is an example of a material, such as titanium, aluminum, or other suitable materials that may be bent into a wave shape through the engagement with gears, such as gears 416 and 418 in wave forming apparatus 400 in FIG. 4. Wave 500 may be a portion of web 404 in FIG. 4.

In this example, wave 500 has gage 502. Gage 502 is the thickness of the material. Wave 500 is a bend in the material that has wave length 504 and amplitude 506. The amplitude also may be referred to as the height of wave 500.

Wave 500 also has centerline radii 510, which originates from point 512 to center 514 of wave 500. Center 514 is around the midpoint between the two surfaces of wave 500. Centerline radii 510 is a line drawn perpendicular to center 514. Outside radii 516 is the outside surface of the bend for wave 500. Inside radii 518 represents the inside surface of the bend for wave 500 in this example. Point 512 originates from line 520 in these examples. Line 520 is a line along the height of wave 500. Inside radii 518 and outside radii 516 refer to each of the local bends. Each of these bends is also referred to as a bend radius.

Figure 6:
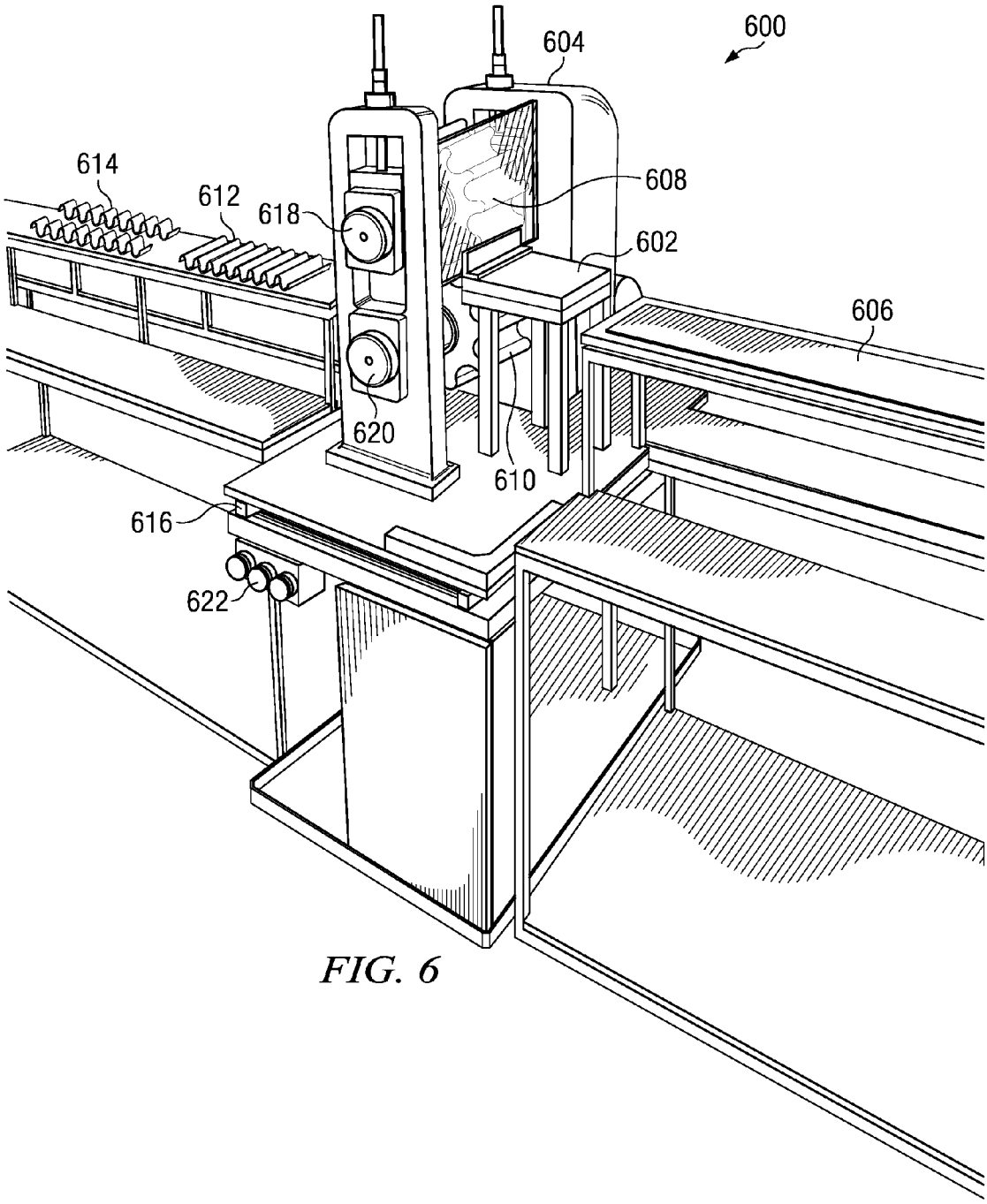
FIG. 6 is a pictorial diagram of a wave forming unit in accordance with an advantageous embodiment.

Turning now to FIG. 6, a pictorial diagram of a wave forming apparatus is depicted in accordance with an advantageous embodiment. Wave forming apparatus 600 is an example of one implementation of wave forming apparatus 400 in FIG. 4. In this example, wave forming apparatus 600 is an example of a device that may generate waves in materials, such as titanium sheets.

In this example, a sheet of material may be fed through guide 602 into housing 604. Guide 602 may guide a material, such as sheet 606, between gears 608 and 610. Gears 608 and 610 engage sheet 606 to create a wave in sheet 606. Gears 608 and 610 are examples of gears 416 and 418 in FIG. 4. Corrugated webs 612 and 614 are examples of sheets of materials that have been processed between gears 608 and 610.

In this example, housing 604 is mounted on stand 616. Stand 616 may take the form of a table, a cart with a rigid flat steel top, or some other suitable structure. Gears 608 and 610 are mounted on shafts 618 and 620. Guide 602 keeps sheet 606 squared and aligned with gears 608 and 610. The operation of wave forming apparatus 600 may be performed using controls 622.

Wave forming apparatus 600 may be implemented using a single stand currently made as part of a progressive roll forming machine with modifications. These types of machines are typically used in groups with one stand being placed after another to form strips of metal by squeezing the strips between multiple pairs of rollers. Each successive pair of rollers progressively bends in more of the desired shape.

This type of machine may be modified by removing the rollers from the shafts. Gears may be mounted on the shafts in place of the rollers to form wave forming apparatus 600. An example of a progressive roll forming machine whose components may be used and modified is an M-series roll forming machine, which is available from Yoder. Yoder is a division of Form Tech Cleveland, Inc. Of course, components from any currently available appropriately sized progressive roll forming machine may be used.

Figure 7:
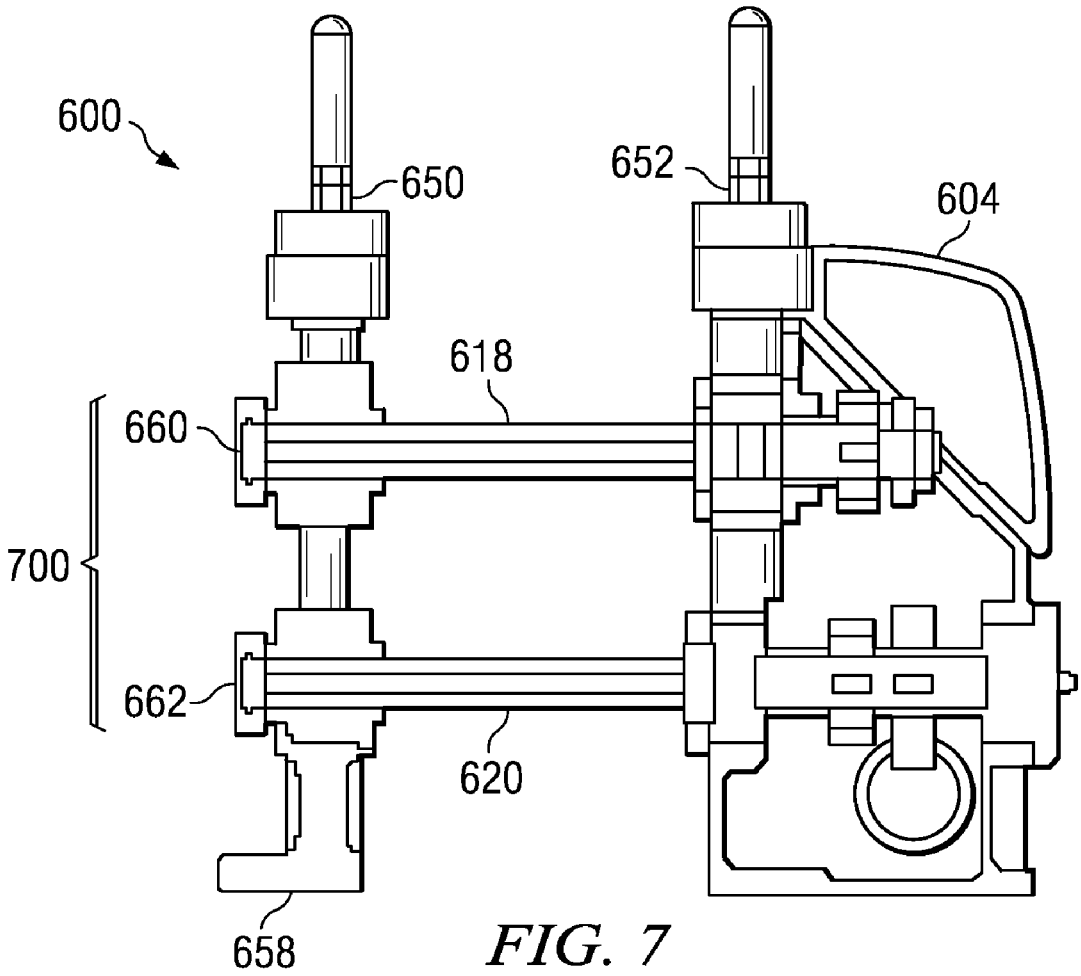
FIG. 7 is a cross-sectional view of a wave forming apparatus in accordance with an advantageous embodiment.

Turning now to FIG. 7, a cross-sectional view of a wave forming apparatus is depicted in accordance with an advantageous embodiment. In this example, gears, such as gears 608 and 610, may be placed onto shafts 618 and 620 in wave forming apparatus 600. Further, in this example, shafts 618 and 620 are spaced apart distance 700. In one embodiment, distance 700 may be adjusted or changed to change the amplitude of a wave by turning nuts 650 and 652 to raise or lower shaft 618.

Of course, other mechanism may be used other than the depicted one in this example. As distance 700 increases, the amplitude of the wave decreases. The forming gears can be exchanged by removing shaft support stand 658 from the shafts and sliding it to the side to expose the end of each of shafts 618 and 620. Stand 658 may be easily removed by removing shaft nut 660 and 662 and sliding it off shafts 618 and 620. The upper shaft location may be adjusted to obtain desired spacing prior to installing the new or reconfigured forming gears and reinstalling stand 658.

Figure 8:
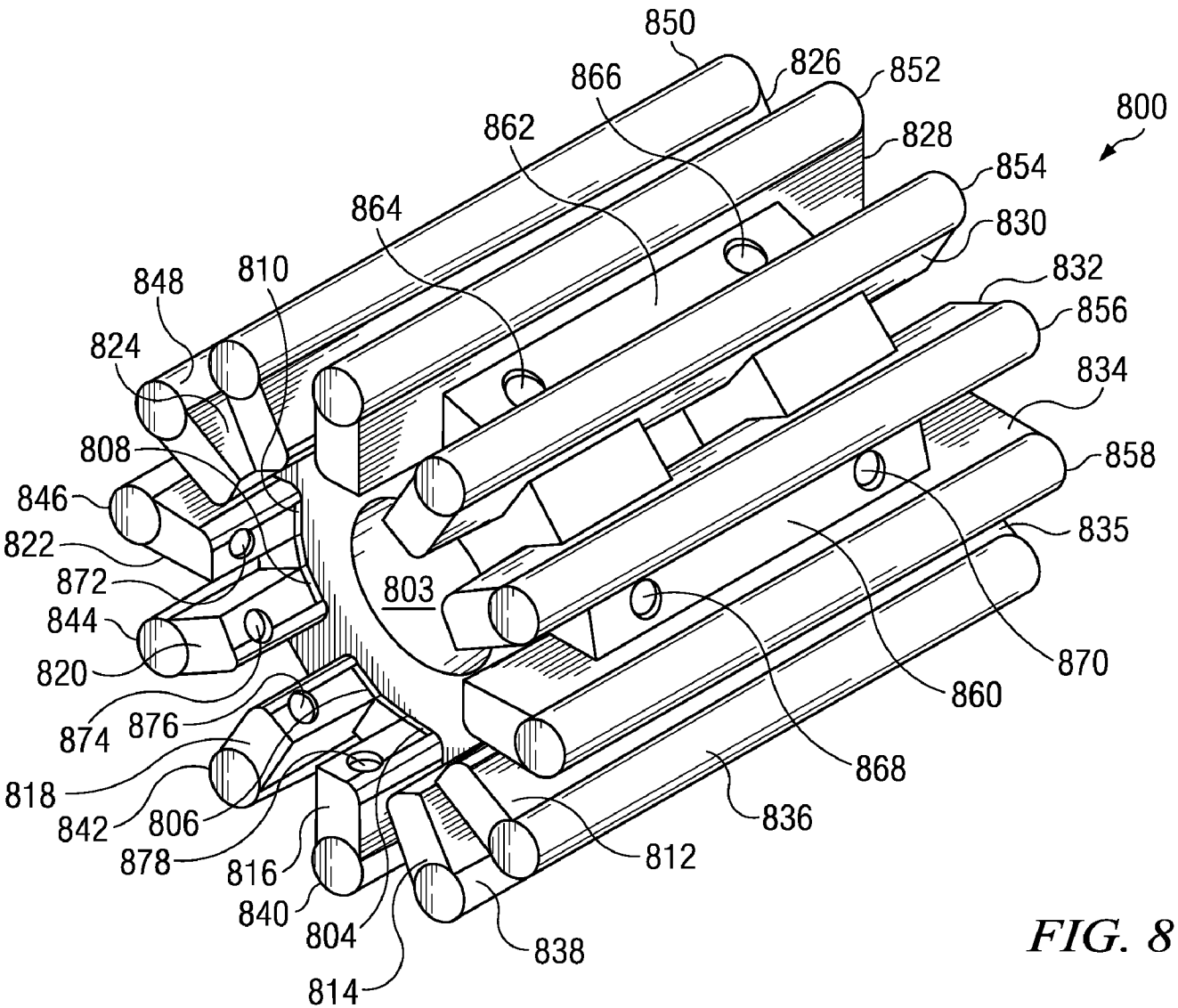
FIG. 8 is a perspective view of a gear in accordance with an advantageous embodiment.

Turning now to FIG. 8, a perspective view of a shim adjustable type gear is depicted in accordance with an advantageous embodiment. Gear 800 is an example of one implementation for gears 416 and 418 in FIG. 4. As depicted, gear 800 includes hub 802. In this example, hub 802 includes bore 803. This bore may receive a shaft to mount gear 800 on the shaft and it may have a key and keyways to transmit torque from the driven shaft.

Additionally, shims 804, 806, 808, and 810 can be seen in this view. Additional shims are present, but not shown in this illustration.

Gear 800 also includes bar holders 812, 814, 816, 818, 820, 822, 824, 826, 828, 830, 832, 834, and 835. The shims may be placed between the bar holders and hub 802 to increase the distance of the bar holders from hub 802. In this manner, the total diameter of gear 800 may be changed. Smaller or larger size shims may be used to make further adjustments to the diameter of gear 800.

Gear 800 also includes bars 836, 838, 840, 842, 844, 846, 848, 850, 852, 854, 856, and 858. These bars are attached to the bar holders and are removable such that different sets of bars may be attached. It may be desirable to change out a set of bars having one diameter with a different set of bars having a different diameter to change a radius of a wave that may be formed. In these examples, the bar holders and the bars form the teeth for gear 800.

The different bars may be selected in different diameters to change the formed radius of the wave. The distance between the gear teeth may be adjusted to change the wave length of the material. In these illustrative examples, longer bar holders and/or shims may be used to increase the distance of a bar from the center of hub 802. This adjustment may be used to increase the wave length.

Gear 800 also includes six wedges, in which only wedges 860 and 862 are visible in this view. These wedges hold the bar holders in place on hub 802 in these examples. In these examples, a wedge may be attached to hub 802 using fasteners, such as fasteners 864 and 866 for wedge 862, and fasteners 868 and 870 for wedge 860. When the wedges are in place, the bar holders are fastened or attached to hub 802. Each wedge holds two bar holders in place.

The different bars are removable and are held in place with fasteners, such as fasteners 872, 874, 876, and 878 as shown on bar holders 822, 820, 818, and 816 respectively. Fasteners are present, although not shown, for the other bar holders. This configuration of components for gear 800 provides an ability to change the wave length and radius of the material.

Thus, gear 800 is a configurable gear in which changing the diameter of the bars may change the bend radius, while changing the distance between the gear teeth through different bar sizes and/or shims may change the wave length. In other embodiments the bars and bar holders may be combined as single components.

Figure 9:
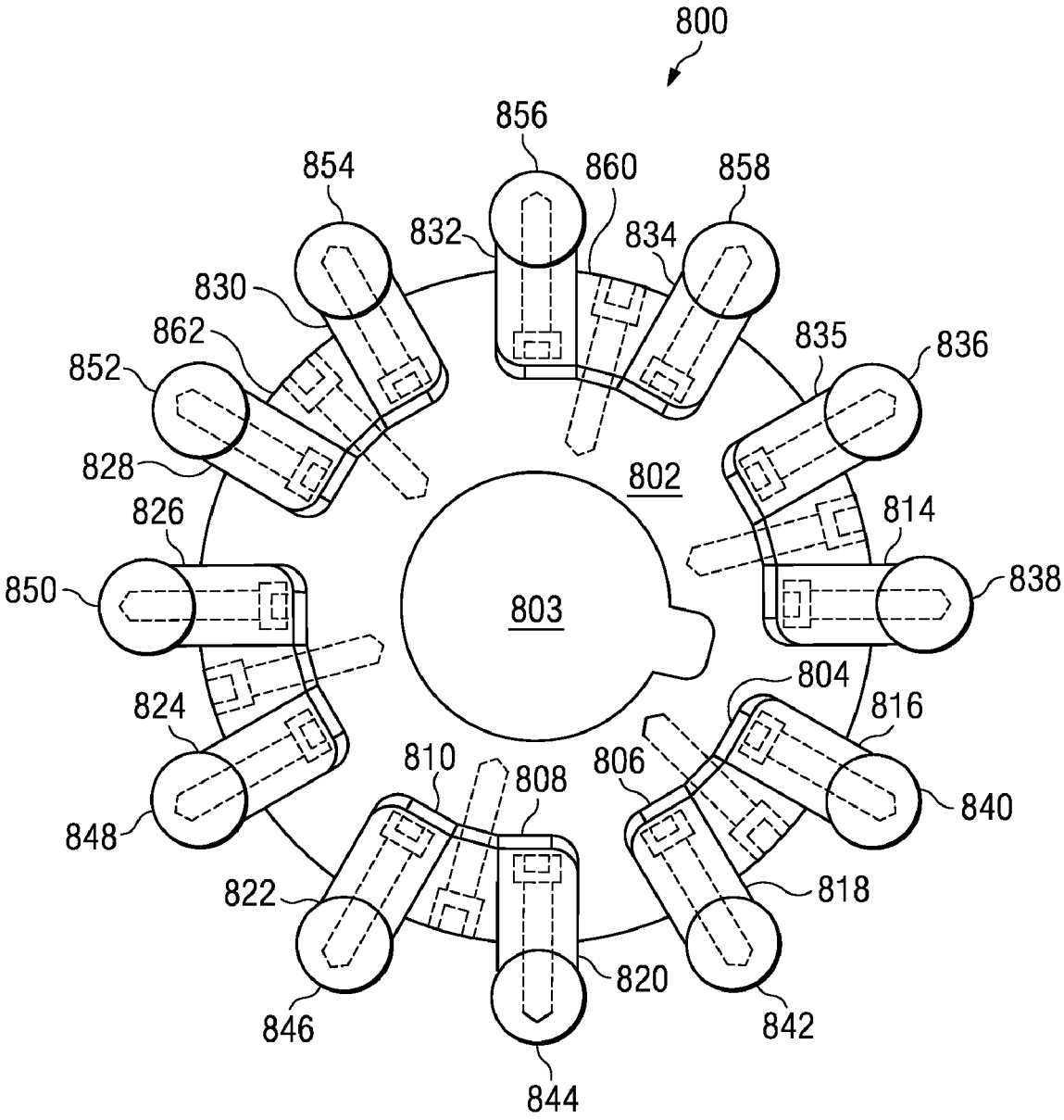
FIG. 9 is a diagram illustrating a cross-sectional view of a gear in accordance with an advantageous embodiment.

Turning now to FIG. 9, a diagram illustrating a cross-sectional view of gear 800 in FIG. 8 is depicted in accordance with an advantageous embodiment. This cross-sectional view provides another illustration of the components that may be configurable for gear 800.

Figure 10:
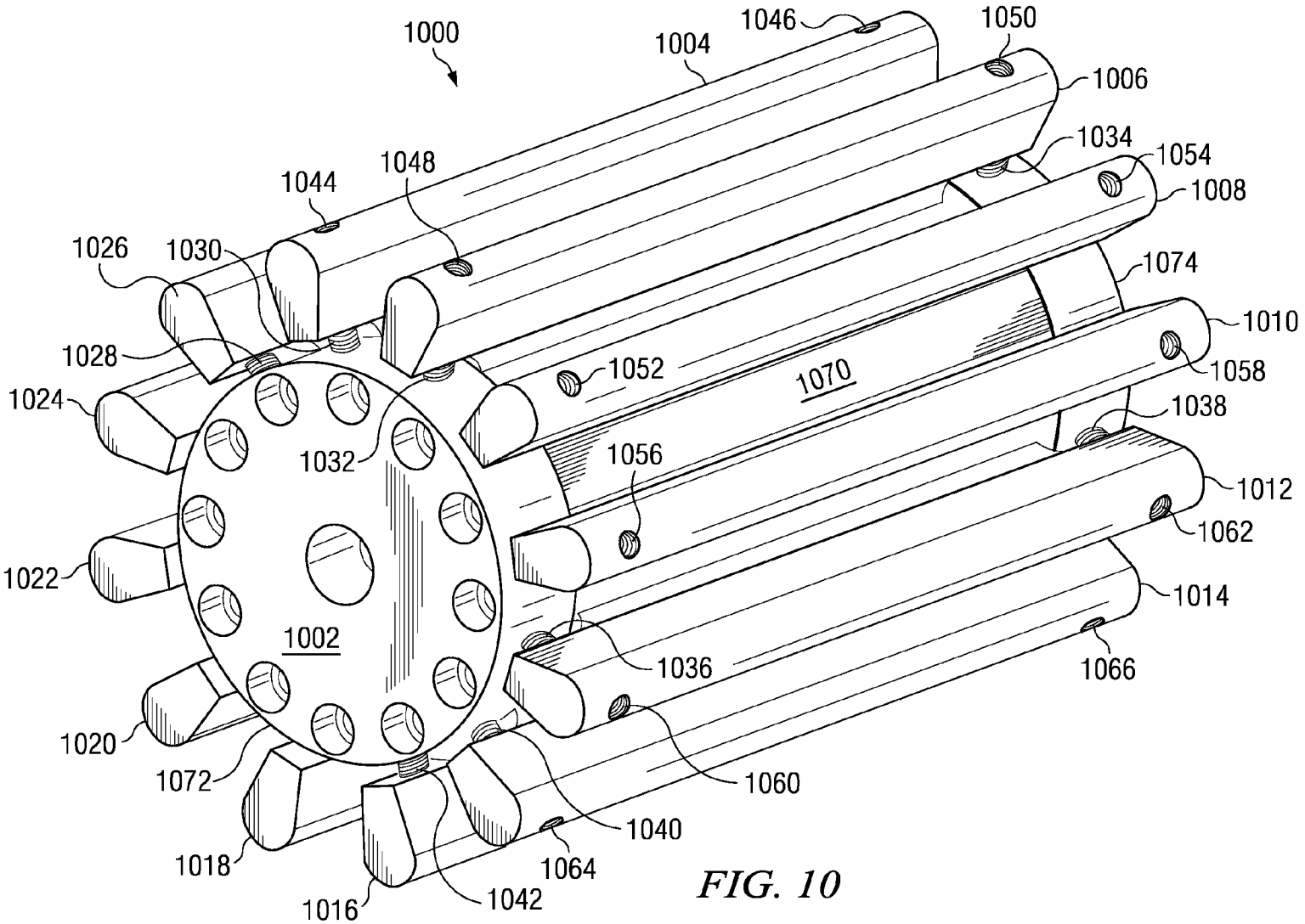
FIG. 10 is an illustration of a screw-type gear in accordance with an advantageous embodiment.

Turning now to FIG. 10, an illustration of a screw-type adjustable gear is depicted in accordance with an advantageous embodiment. In this example, gear 1000 is a screw-type adjustable gear where all the screws are connected by a bevel gear system so that all the teeth move in or out simultaneously as any one or more of the screws are turned. As depicted, gear 1000 includes hub assembly 1002 and bars 1004, 1006, 1008, 1010, 1012, 1014, 1016, 1018, 1020, 1022, 1024, and 1026.

Hub assembly 1002 consists of a center portion 1070 slotted in a manner that allows for the bars to move or slide inwards and outwards with respect to hub 1002. On each end of the hub assembly are end caps 1072 and 1074. These bars may be moved outwards or inwards from hub 1002 to form the teeth for gear 1000 and to change a diameter of gear 1000. When the diameter of gear 1000 changes, the distance between the outer or top surfaces of the bars also change as does the distance between the centers of adjacent teeth. Increasing this distance may increase the wave length of a material, while decreasing this distance may decrease the wave length of a material.

The movement of these bars to change a diameter of gear 1000 is performed by adjusting fasteners in the form of screws. In this example, screws 1028, 1030, 1032, 1034, 1036, 1038, 1040, and 1042 are visible in FIG. 10. Each of these screws has a small bevel gear formed near the inner end and a small bearing boss. A bearing boss is a support for the end of a screw. These screws are affixed to hub 1002 assembly and mounted in a manner such that the screws may rotate with respect to hub assembly 1002. The rotation or turning of these screws changes the position of the bars with respect to hub 1002. These screws are shown in more detail in FIG. 11 below.

In these examples, the fasteners take the form of screws that may move in and out of threaded holes in the bars, such as threaded holes 1044, 1046, 1048, 1050, 1052, 1054, 1056, 1058, 1060, 1062, 1064, and 1066. These screws are affixed to hub 1002 such that the different bars move as these screws are adjusted.

Figure 11:
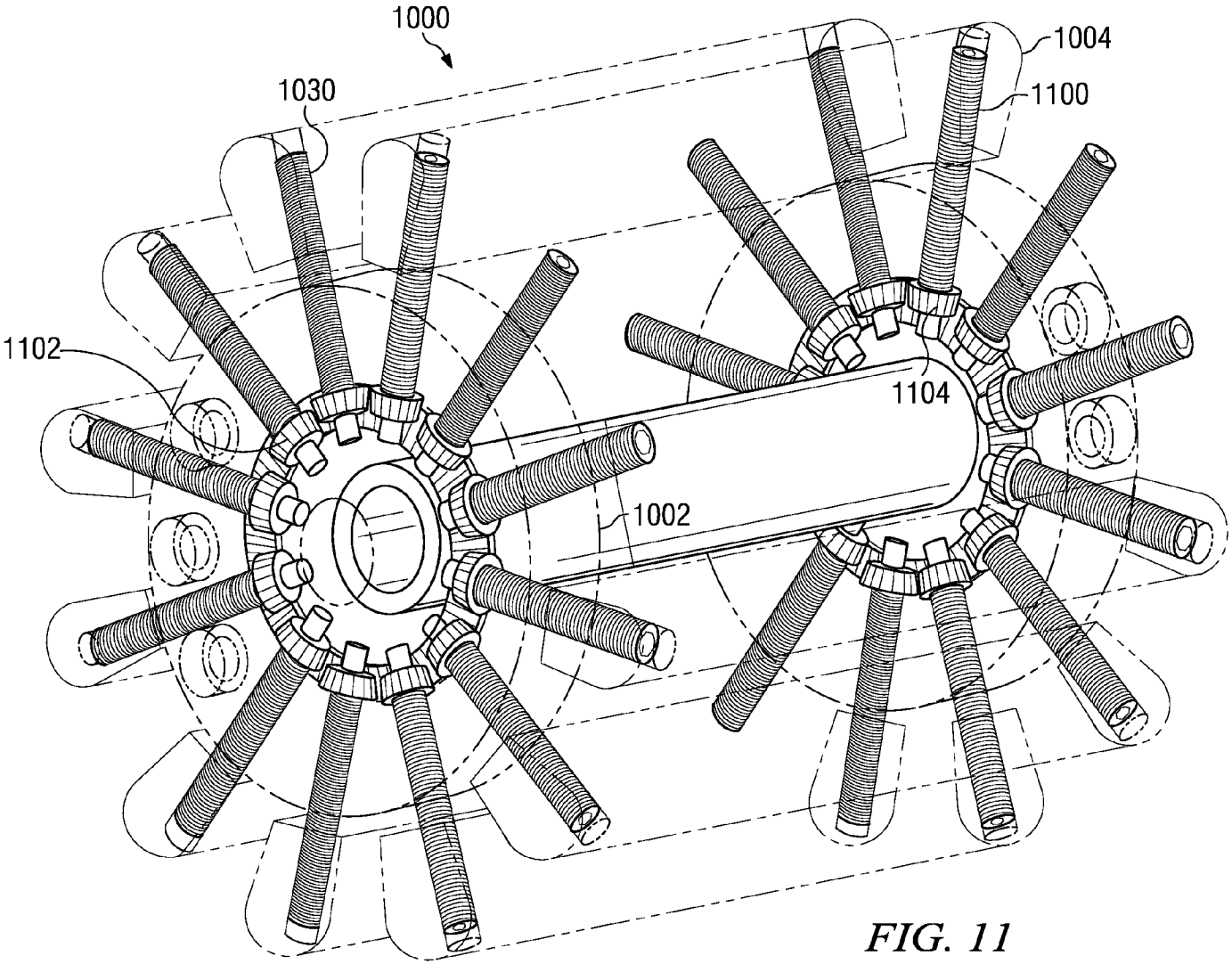
FIG. 11 is an exposed view of a screw-type gear in accordance with an advantageous embodiment.

Turning now to FIG. 11, an exposed view of a screw-type gear is depicted in accordance with an advantageous embodiment. In this example, gear 1000 is shown in an exposed view in which outer parts are illustrated in phantom. This depiction of gear 1000 is provided to illustrate the mechanism used to move bars inwards and outwards from hub 1102.

In this example, only one of the screw structures is described in detail because the other screw structures are in an identical manner. In this example, the small bevel gear 1102 that is part of screw 1030 can be seen. It is rotatable along with screw 1100 to move bar 1004 with respect to hub 1002.

Figure 12:
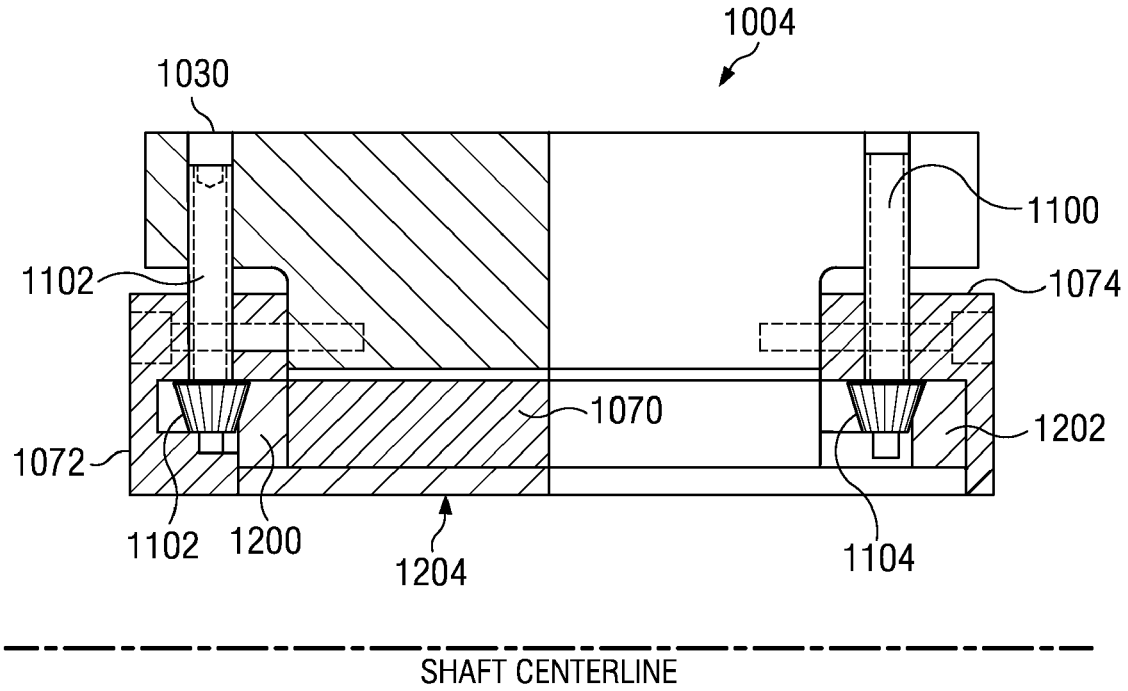
FIG. 12 is a cross-sectional view of a portion of a gear cut through the center of a tooth in accordance with an advantageous embodiment.

With reference now to FIG. 12, a cross-sectional view of a portion of gear 1000 cut through the center of a tooth, is depicted in accordance with an advantageous embodiment. Bevel gear 1102 is rotatable held and constrained in its axial direction by cap 1072. In this cross-sectional view, bevel gears 1200 and 1202 are located near each end of gear 1000 and both to the same side of the small bevel gears.

Bevel gears 1200 and 1202 mesh with the small bevel gears 1102 and 1104. Bevel gears 1200 and 1202 are rotatably connected to tubular shaft 1204 with splines, keys and keyways, or manufactured as a unit such that turning one small bevel gear, by turning its screw 1102 will rotate both larger bevel gears 1200 and 1202 as well as their connecting shaft 1204. The result is that turning one screw will turn all the screws an equal amount and in the same direction for equal motion of all the bars like bar 1004.

In these examples, the teeth of gear 1000 are formed from a single component in the form of bars in contrast to the use of bars and bar holders as illustrated in FIGS. 8 and 9.

Figure 13:
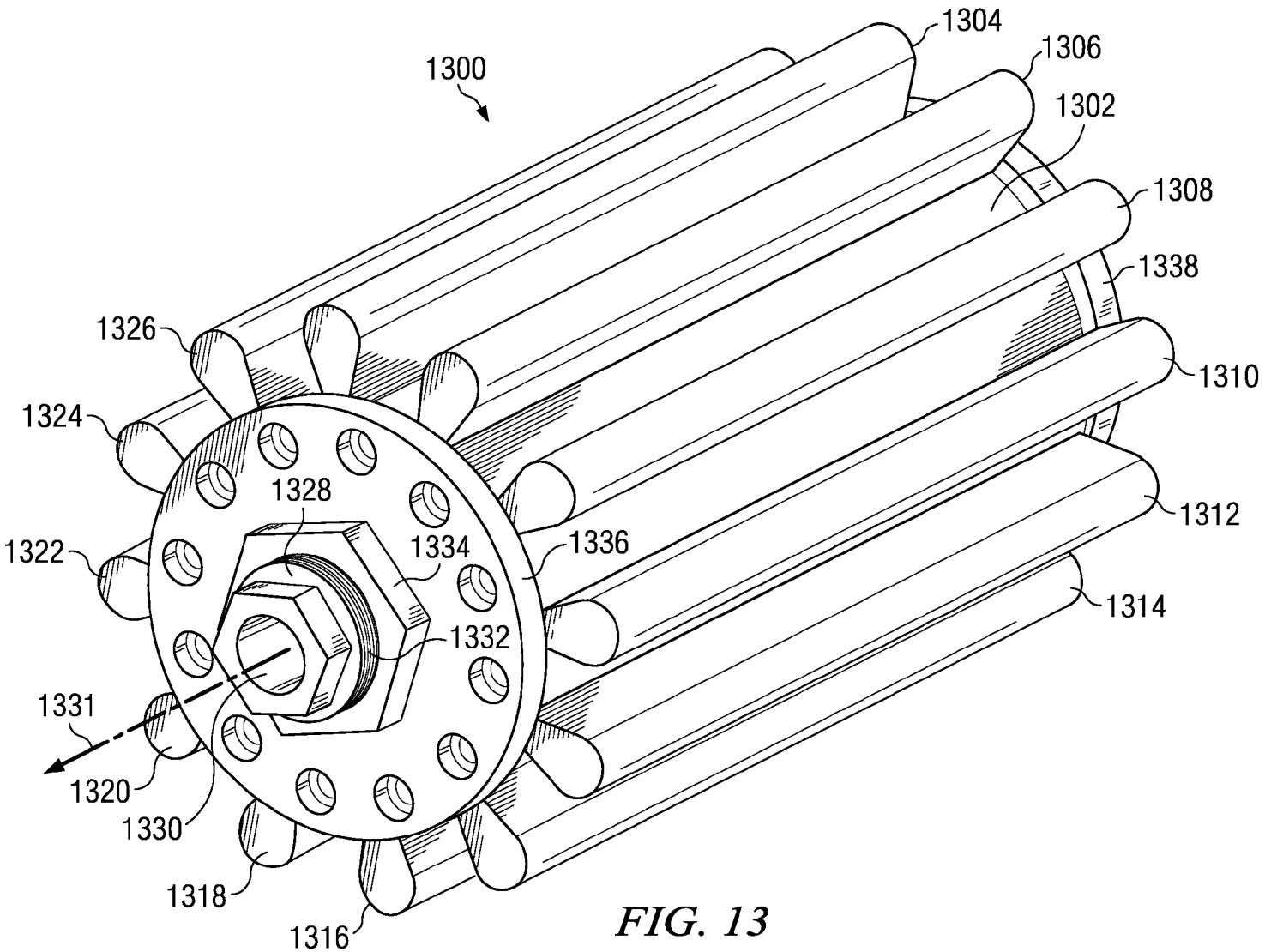
FIG. 13 is a diagram of a cone-type gear in accordance with an advantageous embodiment.

Turning now to FIG. 13, a diagram of a cone-type adjustable gear is depicted in accordance with an advantageous embodiment. This cone-type adjustable gear also allows simultaneous adjustment of the in and out position of all the gear teeth. In this example, gear 1300 is a cone-type adjustable gear. In this example, gear 1300 includes hub 1302. In this example, hub 1302 is a slotted hub. Additionally, gear 1300 includes bars 1304, 1306, 1308, 1310, 1312, 1314, 1316, 1318, 1320, 1322, 1324, and 1326. These bars may be placed into and affixed within the slots in hub 1302.

These bars may be moved outward or inward relative to axis 1331 and hub 1302 by conical wedges (not shown). These conical wedges are illustrated and described in more detail in FIG. 14 below. In this depicted example, hub 1302 includes cone shaft 1328. Cone shaft 1328 has channel 1330 through which a shaft may be received. Additionally, cone shaft 1328 includes threads 1332, which engage an interior portion of end cap 1336. Cone shaft 1328 is rotatable to adjust the extension of bars 1304, 1306, 1308, 1310, 1312, 1314, 1316, 1318, 1320, 1322, 1324, and 1326 from hub 1302. Lock nut 1334 locks threaded shaft 1328 in place to prevent changes in the extension of the bars to maintain a diameter of gear 1300.

In these examples, cone shaft 1328 may be rotated in a clockwise direction to force the bars outward from hub 1302. The bars may be moved inward towards hub 1302 by rotating cone shaft 1328 in a counter clockwise direction. Movement of the bars in an axial direction is prevented by plates 1336 and 1338. In this example, the bars may be adjusted by about ±0.5 inches.

Figure 14:
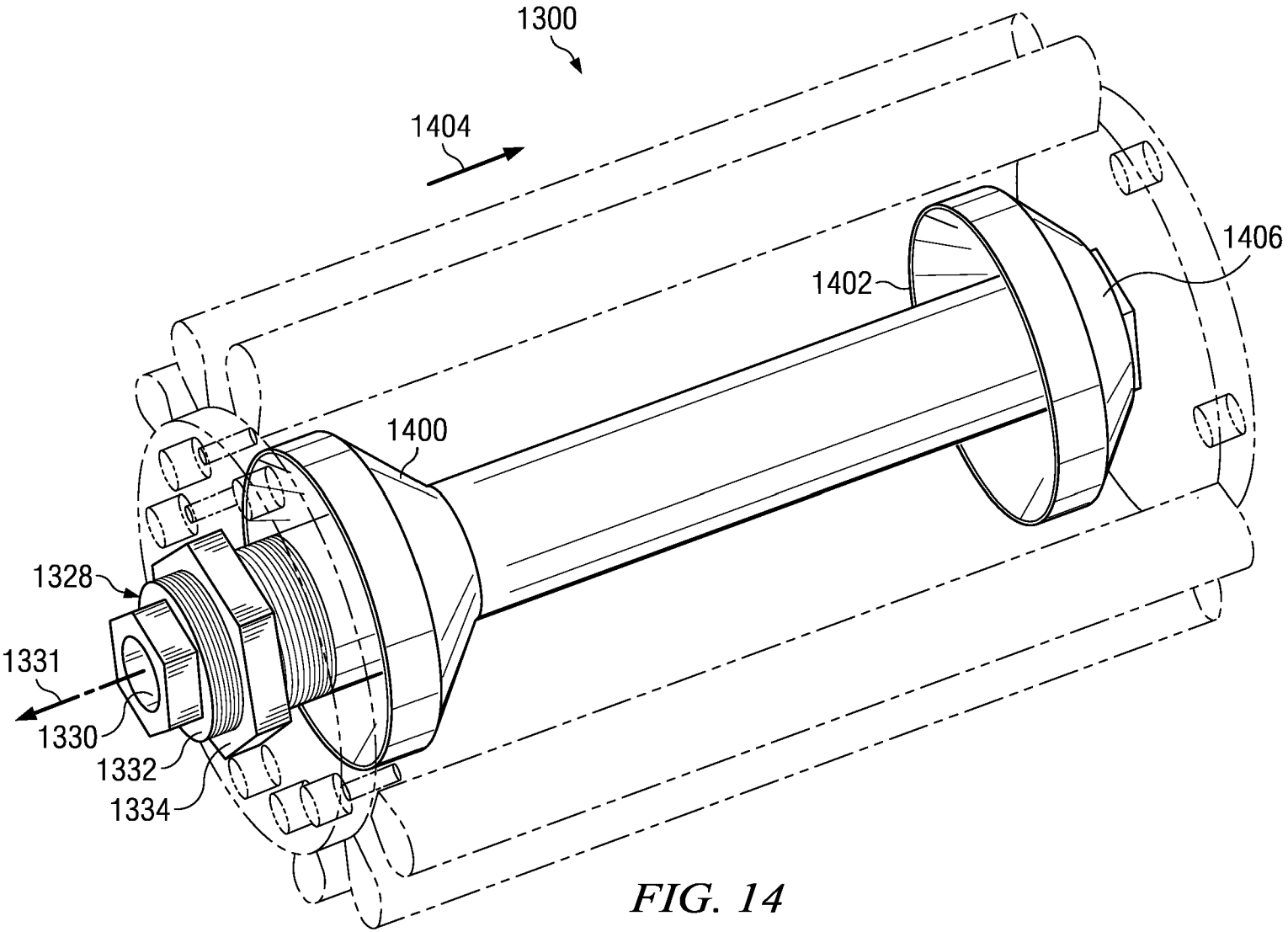
FIG. 14 is an exposed view of a cone-type gear in accordance with an advantageous embodiment.

Turning now to FIG. 14, an exposed view of a cone-type gear is depicted in accordance with an advantageous embodiment. In this example, an exposed view of gear 1300 is provided to further illustrate the configuration of the components in gear 1300. As can be seen in this view, cone shaft 1328 includes conical wedge 1400 and conical wedge 1402. These conical wedges move inward along the direction of arrow 1404 as cone shaft 1328 is turned in a clockwise motion.

Each of the bars used in gear 1300 includes a pair of slots in which conical wedges 1400 and 1402 may fit or engage. As conical wedges 1400 and 1402 move along the direction of arrow 1404, the different bars are extended or move outward from axis 1331 in hub 1302. When cone shaft 1328 is turned in a counter-clockwise direction, conical wedges 1400 and 1402 move along a direction opposite to arrow 1404 and retract the bars inward toward axis 1331 to reduce a diameter of gear 1300.

Figure 15:
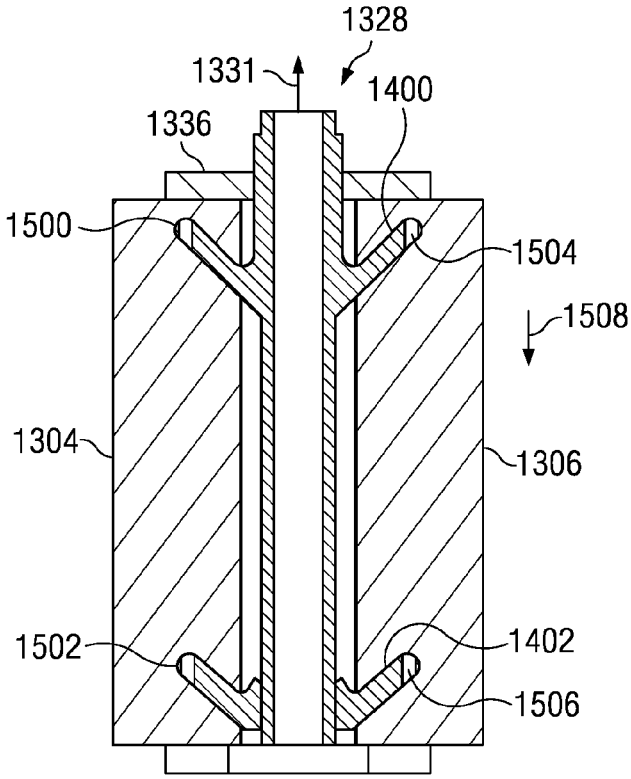
FIG. 15 is a cross-sectional view of a cone-type gear in accordance with an advantageous embodiment.

Turning now to FIG. 15, a cross-sectional view of a cone-type gear is depicted in accordance with an advantageous embodiment. In this example, the cross-sectional view illustrates the mechanism used to move bars inwards and outwards with respect to the hub 1302.

As depicted, bar 1304 includes angled channels 1500 and 1502, while bar 1306 includes angled channels 1504 and 1506. These angled channels engage conical wedges 1400 and 1402. As conical wedges 1400 and 1402 move along the direction of arrow 1508, bars 1304 and 1306 may extend or move outwards with respect to axis 1331 for hub 1302.

The depictions of the different types of gears have been provided as illustrative examples of gears that use configurable components. In some of the examples, the configurable components may be moved or adjusted to change the diameter of the gear. In other examples, components, such as a bar for the tooth of a gear, may be changed with another set of components having a different size to alter a diameter of the teeth to change the radius of a wave. In other embodiments, a gear may employ different numbers of bars and bar holders may be used. The depicted embodiments are for purposes of illustrating one embodiment.

In other embodiments, fewer or more bars and/or bar holders may be used. These variations are presented for purposes of illustrating only a few configurations and/or examples that may be implemented in the different advantageous embodiments. The different illustrative examples are presented only for purposes of illustrating some embodiments and not meant to limit the manner in which different gears may be constructed or designed for the different advantageous embodiments.

Figure 16:
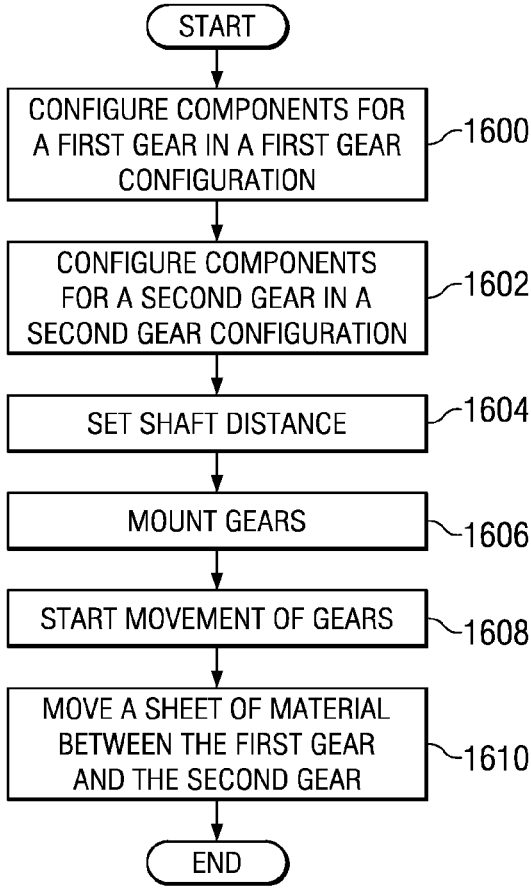
FIG. 16 is a flowchart of a process for forming waves in a sheet of material in accordance with an advantageous embodiment.

Turning now to FIG. 16, a flowchart of a process for forming waves in a sheet of material is depicted in accordance with an advantageous embodiment. The process illustrated in FIG. 16 may be implemented using a wave forming apparatus, such as wave forming apparatus 400 in FIG. 4.

The process begins by configuring components for a first gear in a first gear configuration (operation 1600). The process then configures components for a second gear in a second gear configuration (operation 1602). In operations 1600 and 1602, the different gears are configured to select a desired wave length and radius for the waves formed in the sheet of material.

Next, a shaft distance is set (operation 1604). The shaft distance sets the distance between the gears to adjust the amplitude of the waves generated in the sheet of material. The process then mounts the gears on the shafts (operation 1606). Movement of the gears is started (operation 1608). The sheet of material is then moved between the first gear and the second gear as they move to form waves in the sheet of material (operation 1610). The process then terminates.

The configuration of the gears may be changed each time a sheet of material is passed between and engaged by the gears. The change in these configurable gears allows for adjustments in the parameters of waves formed in the sheet of material. The parameters include, for example, the wave length and radius of the waves.

Thus, the different advantageous embodiments provide a method and apparatus for forming waves in sheets of materials. In the different advantageous embodiments, a sheet of material may be moved between two rotating or moving gears. The gears engage the sheet as the sheet moves between the gears to form a wave. These gears are formed or constructed from configurable components that may be changed to obtain the desired wave length and radius for waves formed by sheets of material moved between the moving gears. Additionally, a distance between two gears may be adjusted to change the amplitude of these waves.

In this manner, the need for having multiple sets of gears for different gauges and different qualities of the same gauges is avoided. The different advantageous embodiments allow for different parts of the gears to be changed or moved to obtain the desired characteristics for waves formed using these gears. As a result, only an adjustment or positioning of a component in a gear needs to occur. In other embodiments, one component may be replaced with another component without requiring another entire new set of gears to be produced.

The description of the different advantageous embodiments has been presented for purposes of illustration and description, and is not intended to be exhaustive or limited to the embodiments in the form disclosed. Many modifications and variations will be apparent to those of ordinary skill in the art.

Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus for bending sheet metal, comprising:

a housing;

a first shaft mounted in the housing;

a second shaft mounted in the housing in a position parallel to the first shaft;

a first gear mounted on the first shaft, wherein the first gear comprises a first hub and a first plurality of teeth on the first hub;

a second gear mounted on the second shaft, wherein the second gear comprises a second hub and a second plurality of teeth on the second hub; and a motor, wherein the motor is configured to rotate both the first gear and the second gear, wherein the first gear and the second gear are configured to engage the sheet metal passed between the first gear and the second gear while the first gear and the second gear are moving, wherein the first plurality of teeth are configured to be adjusted in a radial direction on the first hub to change a diameter of the first gear and the second plurality of teeth are configured to be adjusted in a radial direction on the second hub to change a diameter of the second gear to change a wavelength of waves formed in the sheet metal engaged by the first gear and the second gear without changing the first hub and the second hub, and wherein a distance between the first shaft and the second shaft can be adjusted to change an amplitude of the waves formed in the sheet metal engaged by the first gear and the second gear.

2. The apparatus of claim 1, wherein the first plurality of teeth and the second plurality of teeth have ends configured to be configured with different diameters to change a radius of the waves.

3. The apparatus of claim 1 further comprising:

a guide configured to feed the sheet metal between the first gear and the second gear.

4. The apparatus of claim 1, wherein the first gear and the second gear are selected from one of a shim adjustable gear, a cone-type adjustable gear and a screw-type adjustable gear.

5. The apparatus of claim 1, wherein the first plurality of teeth comprises a plurality of bar holders and a plurality of bars, wherein the plurality of bars are attached to the plurality of bar holders.

6. The apparatus of claim 5, wherein the plurality of bar holders are moveable with respect to the first hub to change a diameter of the first gear.

7. The apparatus of claim 5, wherein the plurality of bars is a first plurality of bars each having a first diameter, wherein the first plurality of teeth further comprises a second plurality of bars each having a second diameter, and wherein the first plurality of bars are configured to be removed from the plurality of bar holders and to be replaced with the second plurality of bars.

8. The apparatus of claim 1, wherein the sheet metal is comprised of a material selected from one of titanium and a titanium alloy.

9. An apparatus comprising:

a first gear, wherein the first gear comprises a first hub and a first plurality of teeth on the first hub; and a second gear, wherein the second gear comprises a second hub and a second plurality of teeth on the second hub, wherein the first plurality of teeth are configured to be adjusted in a radial direction on the first hub to change a diameter of the first gear and the second plurality of teeth are configured to be adjusted in a radial direction on the second hub to change a diameter of the second gear to change a wavelength a of waves formed in a sheet metal passed between and engaged by the first gear and the second gear when the first gear and the second gear move without changing the first hub and the second hub.

10. The apparatus of claim 9, wherein the first plurality of teeth and the second plurality of teeth are configured to be configured to change a radius of the waves.

11. The apparatus of claim 9 further comprising:

a first shaft, wherein the first gear is mounted on the first shaft; and a second shaft, wherein the second gear is mounted on the second shaft and wherein a distance between the first shaft and the second shaft can be adjusted to change an amplitude of the waves formed in the sheet metal.

12. A method for forming waves in a sheet of material, the method comprising:

configuring a first plurality of teeth on a first hub for a first gear and a second plurality of teeth on a second hub for a second gear in a first configuration;

moving the first gear in the first configuration and the second gear in the first configuration;

passing a first sheet of material between the first gear and the second gear while they move in the first configuration, wherein the first sheet of material is engaged by the first gear and the second gear as the first sheet of material passes between the first gear and the second gear to form waves in the first sheet of material;

adjusting in a radial direction the first plurality of teeth on the first hub to change a diameter of the first gear and adjusting in a radial direction the second plurality of teeth on the second hub to change a diameter of the second gear in a second configuration without changing the first hub and the second hub;

moving the first gear in the second configuration and the second gear in the second configuration; and passing a second sheet of material between the first gear and the second gear while they move in the second configuration, wherein the second sheet of material is engaged by the first gear and the second gear as the second sheet of material passes between the first gear and the second gear to form waves in the second sheet of material.

13. The method of claim 12, wherein the configuring step comprises:

selecting the diameter for the first gear and the second gear to form a desired wavelength for the waves.

14. The method of claim 12, wherein the configuring step comprises:

selecting the teeth to have top sections with a selected diameter to form a desired radius for the waves.

15. The method of claim 14, wherein the teeth comprise a plurality of bar holders attached to a plurality of bars, wherein the plurality of bars is the top sections of the teeth with the selected diameter.

16. The method of claim 12, wherein the first plurality of teeth comprises:

a plurality of bar holders and a plurality of bars.

17. The method of claim 12, wherein the first gear and the second gear are selected from one of a shim adjustable gear, a cone-type adjustable gear and a screw-type adjustable gear.

18. The method of claim 12 further comprising:

placing the first gear on a first shaft and the second gear on a second shaft prior to moving the first gear and the second gear, wherein the first shaft and the second shaft are about parallel to each other and have a distance between each other.

19. The method of claim 18, wherein the distance is selected to set an amplitude for the waves.

20. The method of claim 12, wherein the sheet of material is comprised of a material selected from titanium and a titanium alloy.

* * * * *